United States Patent [19]

Fraterrigo

[11] 4,166,553

[45] Sep. 4, 1979

[54] DISPOSABLE DISPENSING-PROPORTIONING CONTAINER FOR SEMI-FLUID PASTY PRODUCTS IN GENERAL, AND COSMETICS PRODUCTS IN PARTICULAR

[76] Inventor: Salvatore G. Fraterrigo, via Casoli, 17, Carpi, Modena, Italy

[21] Appl. No.: 804,251

[22] Filed: Jun. 7, 1977

[30] Foreign Application Priority Data

Mar. 30, 1977 [IT] Italy ..... 46843 A/77

[51] Int. Cl.[2] ..... B65D 35/52

[52] U.S. Cl. ..... 222/181; 222/207; 222/490

[58] Field of Search ..... 220/306; 150/0.5; 215/100 R; 222/207, 209, 213, 214, 180, 181, 185, 490

[56] References Cited

U.S. PATENT DOCUMENTS

| | | | |
|---|---|---|---|
| 2,565,917 | 8/1951 | Hammerstein | 222/490 |
| 2,772,817 | 12/1956 | Jauch | 222/213 X |
| 3,171,565 | 3/1965 | Mozette | 222/306 X |
| 3,220,611 | 11/1965 | Zander et al. | 222/207 X |
| 3,223,278 | 12/1965 | Allen | 220/306 |
| 3,539,081 | 11/1970 | Norton | 222/185 |

*Primary Examiner*—David A. Scherbel
*Attorney, Agent, or Firm*—Brisebosi & Kruger

[57] ABSTRACT

A disposable manually operable wall mounted dispenser having a deformable rubber teat on the bottom of the container, which when pressed by a user's finger compresses and forces liquid through a dispensing slit in the bottom thereof. The dispensing unit is mounted to the wall by a mounting plate with a projection and a cooperating depression in the container.

6 Claims, 4 Drawing Figures

DISPOSABLE DISPENSING-PROPORTIONING CONTAINER FOR SEMI-FLUID PASTY PRODUCTS IN GENERAL, AND COSMETICS PRODUCTS IN PARTICULAR

SUMMARY OF THE INVENTION

This invention relates to disposable containers for cosmetics products in particular, and for semi-fluid pasty products in general.

In recent times, cosmetics products such as bath foams, liquid soaps and special types of toothpastes or creams, and generally sold in disposable plastics containers, have become very widespread.

It is often difficult to use these containers, especially when they are of large size, as it is not possible to accurately proportion the product to be withdrawn from the container. In this respect, the need to fill the container, generally by machine, requires the use of fairly wide container mouths. These wide mouths are unsuitable for accurate proportioning of the product held in the container, especially when the container is of large size.

A further difficulty in the use of disposable plastics containers is that in the bathrooms or other rooms in which they are to be used there is often nowhere to support them, especially when of large size.

The object of the present invention is to provide a special type of disposable container which may be constructed by moulding plastics material, and is provided with a wide filling mouth suitable for machine filling, but which completely obviates all the aforementioned drawbacks in that it is provided with a mouth dispensing a predetermined quantity and of automatic closure, and with means for stably fixing it to a wall.

These objects are attained according to the invention by providing the container with a test fitted to the filling mouth, the test remaining integral during its manufacture but being provided with a cut immediately before use.

The material is made to flow out through the aforesaid teat by compressing it between the fingers, this compression causing it to deform and thus the cut to open.

The proportioning is facilitated according to the invention by the fact that the teat is covered at least over a half circumference by a rigid screen against which it lies, said teat being provided with a protuberance arranged to remain stably resting against said rigid screen during the deformation of the teat. According to the invention the rigid screen comprises a large front aperture arranged to enable said teat to be deformed by pressure with one finger, and generally the thumb.

Further according to the invention, the proposed container has a flat base, and is provided at said base with a cylindrical cavity into which a cylindrical appendix is firmly inserted and locked. Said cylindrical appendix branches from a plate which may be firmly fixed to a wall by gluing.

According to the invention, when the appendix is inserted into the cylindrical cavity in the container base, said plate becomes locked between two lateral fins which prevent the container from rotating about the cylindrical support appendix.

These and further constructional and operational characteristics of the invention will be more evident from the detailed description given hereinafter with reference to the figures of the accompanying drawings which illustrate one preferred embodiment by way of nonlimiting example.

Figure 1:
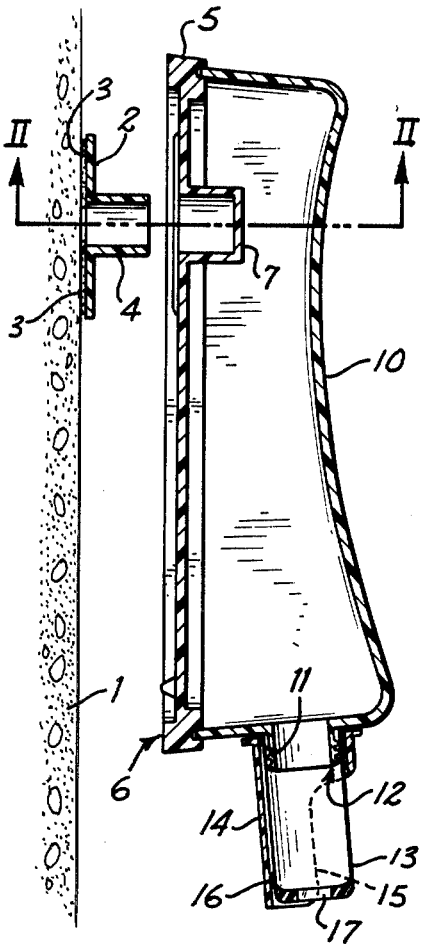
FIG. 1 is a vertical section through the invention while undergoing fixing to a wall.

The aforesaid figures show a wall 1 to which the plate 2, provided at its rear with two self-adhesive surfaces 3 has been firmly fixed, the cylindrical appendix 4 branching from the front of the plate. Said cylindrical appendix 4 is designed to support and firmly fix the dispensing-proportioning container according to the invention on the wall. This container consists of a flat base wall 5 provided with a rear external peripheral support rib 6 and a cylindrical cavity 7 conjugate with the cylindrical appendix 4.

To the sides of the cylindrical cavity 7 there are provided two projecting ribs 8 arranged to exactly contain the plate 2 between them so as to prevent it from rotating.

The peripheral rim of the plate 5 comprises a groove 9 into which is forcibly inserted a front shaped shell 10 defining the container body in combination with the plate 5. Said shaped shell 10 lowerly comprises a filling and discharge mouth 11 provided externally with a sawtoothed surface 12. Over the outside of the filling and discharge mouth 11 there is mounted a cylindrical teat 13 of rubber or an equivalent elastomer, and remains locked on the outer sawtoothed surface 12. Over the outside of the teat 13 there is mounted a cylindrical member 14 which locks onto the teat and becomes supported by the filling and discharge mouth 11.

Figure 3:
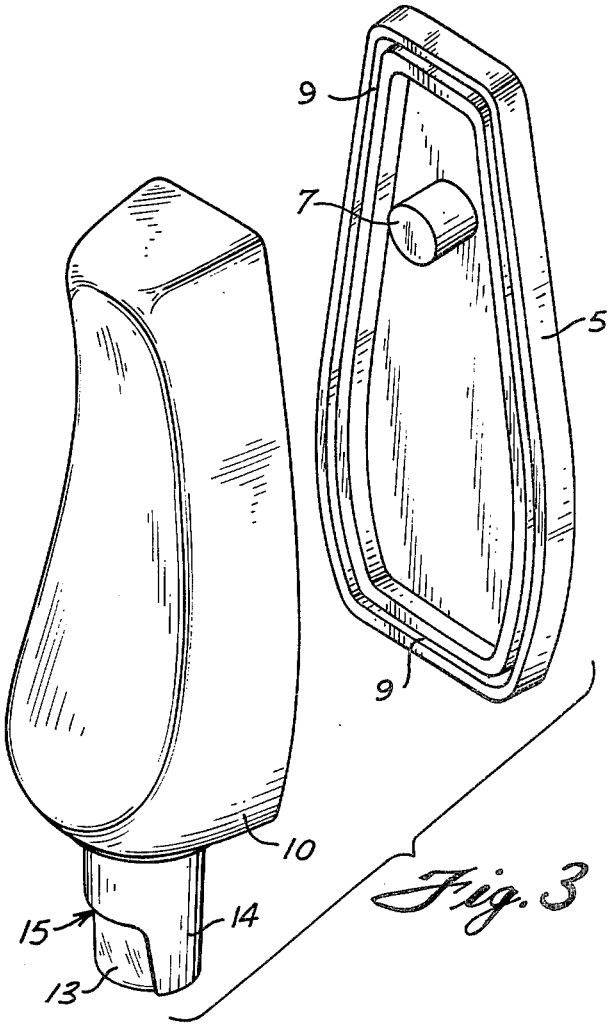
FIG. 3 is an exploded perspective view of the invention disassembled into the two component parts obtained by moulding.

The member 14 is in the form of a hollow cylinder of dimensions slightly greater than the dimensions of the teat, and comprising a front missing portion 15 (see FIG. 3). The teat 13 comprises to its rear a protuberance 16 designed to remain firmly resting on the outer shell 14, and arranged to facilitate deformation of the teat 13 by the action of one finger pressing on the missing portion 15 of the shell 14.

Under normal conditions the teat is perfectly closed, whereas after the container has been fixed to the wall and is ready for use, a cut 17 orientated as shown in FIG. 1 is made in the teat 13 by a blade or knife.

The use of the container heretofore described is as follows:

Having chosen the wall region, for example in a shower cabinet, to the side of the mirror above a wash basin or in another convenient position, to which to fix the container which may contain liquid soap, bath foam, toothpaste, brilliantine or any other required cosmetics product, the plate 2 is fixed to the wall region by simple pressure to bring the self-adhesive regions 3 into contact with the wall.

The plate 2 must evidently be fixed with two sides perfectly vertical in order to ensure correct vertical orientation of the container.

Figure 2:
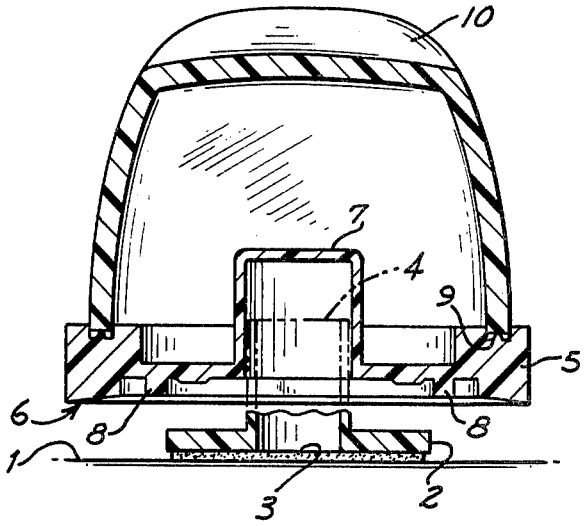
FIG. 2 is a section on the line II—II of FIG. 1.
Figure 4:
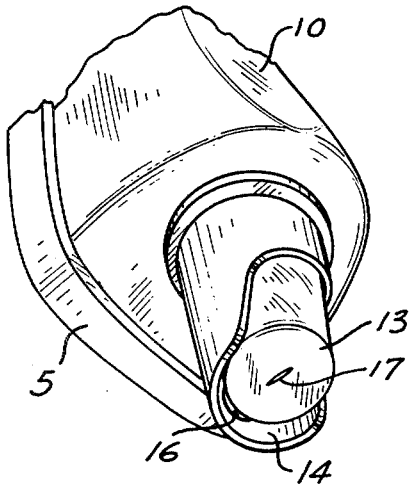
FIG. 4 is a perspective view from below of the cut teat during proportioning.

When the plate 2 has been fixed, the container is fitted to the wall by simply pushing the rear cavity 7 over the appendix 4, taking care that the plate 2 becomes inserted and locked between the lateral appendices 8 (see FIG. 2) of the container base 5. Having done this, the end of the rubber teat 13 is opened by means of a cut as shown by 17 in FIG. 1, and the container is ready for use.

In order to extract a measure of the contents, it is necessary only to press the teat 13 by one finger at the front missing portion of the protection cylinder 14. This pressure deforms the teat to consequently open the cut 17, its opening being facilitated by the presence of the rear protuberance 16 provided on the teat 13 and firmly resting on the shell 14.

The invention is not limited to the single embodiment heretofore described, to which variations and improvements may be made, consisting of mechanically equivalent modifications to component parts, without leaving the scope of protection of the present patent, the characteristics of which are summarised in the following claims.

What is claimed is:

1. A disposable manually operable wall mountable dispenser comprising a dispensing container having a dispensing outlet;

wall mounting means for mounting said container on a vertical wall and comprising, a plate of polygon outline having a cylindrical projection;

means for mounting the plate on a vertical wall so that the cylindrical projection extends generally horizontally from the vertical wall;

said dispensing container comprising, a casing for containing the product to be dispensed and including a rear wall forming a portion of the product containing casing;

a cylindrical depression formed in the said rear wall, extending inwardly of said rear wall, and completely sealed with respect to and forming a part of the product containing portion of the rear wall;

said projection having a dimension to be a close fit in said depression to enable mounting the casing on the wall by pressing the casing depression onto the cylindrical projection to a position in which said casing substantially covers and obscures said wall support means from view;

cooperating means on said wall mounting means and said rear wall of the casing for maintaining said container in a predetermined general vertical attitude.

2. A dispenser according to claim 1 further comprising, means adjacent the dispenser outlet for dispensing a product from the container.

3. A container according to claim 1, in which the rear wall of the container is substantially flat, and has a rearwardly extending external peripheral rib extending around and covering said wall mounting means.

4. A container according to claim 1, wherein said cooperating means on said wall mounting means and said rear wall of the casing comprise, a rib on the rear of the casing in engagement with an edge of said plate.

5. A container according to claim 4 wherein said plate is rectangular and said casing further includes a second rib parallel to the first mentioned rib and engaging another edge of said plate.

6. A container according to claim 1 wherein said plate is rectangular, said rear wall of the casing includes a rearwardly projecting peripheral rib, and said cooperating means comprises a pair of ribs within the boundary of said peripheral rib engaging opposite edges of said plate.

* * * * *